United States Patent [19]

Schmitt

[11] Patent Number: 4,582,189

[45] Date of Patent: Apr. 15, 1986

[54] COIN VALIDATION APPARATUS

[75] Inventor: Don Schmitt, Lithonia, Ga.

[73] Assignee: Reed Industries, Inc., Stone Mountain, Ga.

[21] Appl. No.: 589,642

[22] Filed: Mar. 14, 1984

[51] Int. Cl.[4] ..... G07F 3/02

[52] U.S. Cl. ..... 194/317; 194/346

[58] Field of Search ..... 194/97, 99, 102, 1 E, 194/1 R, 100 A, 1 C, 1 D

[56] References Cited

U.S. PATENT DOCUMENTS

| | | | |
|---|---|---|---|
| 1,527,351 | 2/1925 | Egan | 194/1 C |
| 2,683,517 | 7/1954 | Gabrielsen | 194/97 R |
| 3,279,575 | 10/1966 | Johnson | 194/97 R |
| 3,653,481 | 4/1972 | Boxall et al. | |
| 3,918,564 | 11/1975 | Heiman et al. | |
| 3,918,565 | 11/1975 | Fougere et al. | |
| 4,257,512 | 3/1981 | Hooker | 194/100 A |
| 4,286,703 | 9/1981 | Schuller et al. | 194/100 A |
| 4,491,213 | 1/1985 | Marcroft | 194/1 K |

*Primary Examiner*—Stanley H. Tollberg
*Attorney, Agent, or Firm*—Jones & Askew

[57] ABSTRACT

An improved coin validation apparatus for detecting and accepting or rejecting a coin in a limited vertical and horizontal space. The validator includes a first downwardly inclined coin path for guiding a rolling coin along a predetermined first pathway toward a coin box, and a second downwardly inclined short coin path beginning at a predetermined point along the first coin path and positioned below the first coin path for directing a rejected coin from the first coin path along a predetermined second pathway toward a coin return outlet. An electronic coin sensor is positioned to sense the presence of a valid coin travelling along the first coin path, and a coin-directing guide member or flipper is provided along the first coin path to guide a valid coin toward the coin box and to release a rejected coin to fall to the second coin path to the coin return outlet.

23 Claims, 16 Drawing Figures

COIN VALIDATION APPARATUS

TECHNICAL FIELD

The present invention is in the field of coin validators used in vending machines and the like and, in particular, discloses a coin validation apparatus which employs electronic coin sensing apparatus disposed along a coin's path of travel through the validator for providing detection and acceptance or rejection of a coin in a limited vertical space. The preferred embodiment is particularly suitable for retrofitting into conventional coin meter cases housing conventional coin-slide type validation apparatus.

BACKGROUND OF THE INVENTION

Coin operated machinery for vending goods or services in response to insertion of predetermined amounts of coin money are in wide, spread use both in the United States and throughout the world. Since one of the principal objects of constructing these machines is that they may be operated while unattended by the owner, the unforunate but inevitable result has been that a large number of people attempt to cheat coin operated machines. Among the common forms of cheating, or attempting to cheat, coin operated machines are the use of slugs and the technique of "stringing."

The use of slugs is based on use of a non-coin piece of metal of a size identical to, or substantially similar to, the size of a valid coin. It is inserted into the machine in an attempt to operate it. Stringing is a cheating method whereby a piece of string is wrapped around the outer diameter of a coin and is used to lower, and then attempt to remove, a coin from a vending machine so that the mechanism responds to insertion of the coin but the coin does not drop into the coin box.

Since the invention of the transistor, more and more vending machines are using electronic apparatus in coin validators. For example, co-pending application Ser. No. 525,997 filed 8-24-83 now U.S. Pat. No. 4,509,633, entitled "Electronic Coin Validator With Improved Diameter Sensing Apparatus" owned by the assignee of the present invention, discloses an improved electronic coin validator with an improved diameter sensing apparatus using only two coin sensors disposed along a coin's path of travel through the validator which ascertains the coil's diameter by calculating the average velocity of the coil as it passes the sensors.

Among the advantages of electronic coin validators are greater reliability, and the fact that such electronic coin validators may be designed to be much more immune to the use of slugs than many mechanical validators. For example, slide type mechanical coin chutes are virtually unable to detect slugs if the diameter and thickness of the slug are the same as that of a valid coin. Electronic coin validators such as in the above-described co-pending application provide various arrangements for detecting not only the diameter of coins but also electronically sensing the metallic content of the coin as it traverses a predefined path along the runway through the validator.

Additionally, the use of modern electronics in coin validators has allowed arrangements wherein a single coin path for accepting all coins may be defined, but wherein the validator can detect the presence of a plurality of different denominations of coins having different metal content and different diameters. The apparatus described in the above-referenced co-pending application discloses a validator apparatus wherein there is but a single coin path for accepting all coins, and wherein valid coins are allowed to leave the coin path and exit downwardly from the coil path into a coin receptacle or box.

Many existing coin operated vending machines employ a coin meter case for housing a coin-slide type coin validation apparatus. Such coin meter cases are frequently found in laundry washing machines. Conventional coin meter cases typically include a vertical front wall for mounting and supporting the coin slide apparatus, and for supporting the discharge openings of the coin slide apparatus above an interior horizontal floor of the coin meter case. The interior horizontal floor typically includes a coin box opening for allowing valid coins from the coin slide to drop into a coin box positioned in the coin meter case beneath the floor. Accordingly, the vertical front wall of the coin meter case includes a cut-out opening for receiving that portion of the coin slide apparatus to be positioned over the coin box opening, and thus includes a portion of the vertical front wall which extends to a predetermined height above the floor to define an opening in the front wall.

Because of the widespread use of coin meter cases of this type, and the difficulties encountered with conventional coin-slide type validation apparatus, there is a need for the newer type electronic coin validation apparatus to be adapted for use with these existing conventional coin meter cases. However, because of the unique geometry of the coin meter cases, electronic coin validators such as shown in the above-referenced co-pending application cannot be adapted for use with these conventional coin meter cases, principally because of the space and mounting constraints.

If the coin meter case is not physically altered to receive electronic coin validator apparatus, the front wall opening in the coin meter case defines a boundary which limits the ability to return a coin if the coin proves to be bogus. If the coin is allowed to travel beyond the front wall boundary during the examination or validation of the coin, the coin may not have sufficient vertical drop along the path of travel to maintain the coin's velocity to return the coin. Thus, the geometry of unaltered coin meter cases is such that there is a limited vertical space within which a valid coin must be detected and allowed to pass beyond the front wall and thence into the coin box, or rejected prior to passing beyond the front wall so that the bogus coin can be returned to the coin return opening.

Accordingly, there is a need in the art to provide an improved coin validation apparatus which allows the detection and acceptance or rejection of a coin in a limited vertical and horizontal space, such as in a conventional coin meter case wherein the coin must be accepted or rejected prior to the passing of the coin beyond the front wall. It would be preferable to provide for coin validation without altering the coin meter case.

SUMMARY OF THE INVENTION

The present invention provides an improved coin validation apparatus which allows for the detection and acceptance or rejection of a coin in a limited vertical and horizontal space. The preferred embodiment of the present invention is therefore particularly suitable for use in retrofitting conventional coin meter cases constructed for housing conventional coin-slide validators with the more modern and reliable electronic coin detection devices, without physically altering or modifying the coin meter cases.

Briefly described, the present invention includes a coin introducing slot for receiving a coin in a generally vertical orientation and for guiding the coin to roll downwardly and into the apparatus. Disposed immediately behind the coin introducing slot is a first downwardly inclined coin path for guiding the rolling coin along a predetermined first pathway toward the coin box. Generally, then, the first inclined coin path extends from the coin introducing slot downwardly and to a discharge opening positioned immediately above a coin receptacle or box.

A second downwardly inclined coin path is provided beginning at a predetermined point along the first coin path and positioned below the first coin path for directing rejected coins from the first coin path along a predetermined second pathway toward a coin return outlet.

Bogus coins are detected by electronic coin sensing devices which are positioned along the first coin path prior to the point of beginning of the second coin path and which sense the presence of a valid coin introduced into the apparatus and travelling along the first coin path. A signal provided by the coin sensing devices directs an accept-reject flipper or guide to either guide a valid coin past the predetermined point of beginning of the second coin pathway toward the coin box, or to release a rejected coin to fall from the first coin path downwardly to the second coin path should the coin be detected as bogus. Accordingly, an invalid or bogus coin detected by the coin sensing devices will be released to fall downwardly onto the second coin path and thence to the coin return outlet. A valid coin will, on the other hand, continue travelling along the first coin path and thence through the coin discharge opening into the coin box.

More particularly described, a coin validation apparatus constructed in accordance with the present invention comprises a generally Y-shaped coin chute having a first long coin path and a second short coin path intersecting the long coin path intermediate the ends thereof at a predetermined point. The Y-shaped coin chute is mounted such that the long coin path defines a first downwardly sloping coin ramp having a first coin-receiving end for receiving a coin in a generally vertical orientation and a second coin-discharging end positioned over a coin box or receptacle for discharging an accepted coin into the box. The short coin path defines a second downwardly sloping coin ramp for receiving a rejected coin from the long coin path and for returning the rejected coin to a coin return opening positioned generally beneath the coin-receiving end of the first coin ramp.

The Y-shaped coin chute is particularly suitable for mounting for use in connection with a conventional coin meter case such that the coin-discharging end of the long coin path extends inwardly of the coin meter case and beyond the vertical front wall so that the coin-discharging end is positioned over the coin box. The remainder of the validation apparatus, including the coin-receiving end of the long coin path and virtually the entire short coin path, is supported on the exterior of the vertical front wall, and allow the detection and acceptance or rejection of the coin prior to allowing the coin to travel appreciably beyond the front wall. The electronic coin sensing devices are positioned after the coin receiving opening and prior to the predetermined point of beginning of the downwardly-sloping short coin path, and the coin directing flipper or guide is positioned at or near the predetermined point such that an invalid coin detected will be released to fall downwardly from the long coin path to the short coin path and thence to roll to the coin return outlet. Accordingly, the detection and acceptance or rejection of the coin is accomplished in a limited vertical and horizontal space, defined principally by the portions of the "Y" positioned to the exterior of the front wall of the coin meter case. From the foregoing, it will be appreciated that this arrangement provides for the detection and acceptance or rejection of the coin prior to the point at which the coin irretrievably passes beyond the front wall of the coin meter case such that the angle of the short coin path would be too shallow to allow the coin to roll out through the coin return opening.

Thus, it is an object of the present invention to provide an improved coin validation apparatus for providing detection and acceptance or rejection of a coin in a limited vertical and horizontal space.

It is a further object of the present invention to provide an improved coin validation apparatus which allows the electronic detection of a coin which can be retrofitted into a conventional coin-slide type coin meter case without requiring alteration or modification of the coin meter case. It is a further object of the present invention to provide an electronic coin validation apparatus which provides two separate coin travel pathways so arranged such that the coin continues its travel if detected as valid, while being diverted to a second coin-return path if detected as bogus, so that the apparatus may be employed for use in situations wherein a single continuous-path validation apparatus could not be used because of preexisting geometrical constraints of the mounting for the validation apparatus.

That the present invention accomplishes these objects, and fulfulls other needs which were present in the art of coin validators, will be appreciated from a detailed description of the preferred embodiment to follow.

DETAILED DESCRIPTION OF THE DRAWINGS

Turning now to the drawings, in which like numerals represent like elements throughout the several views, the preferred embodiment of the present invention will be described. It should first be noted that, as illustrated herein, the term "coin" is used to mean any token which is inserted into the validator in an attempt to operate it. The term includes valid coins with which the machine is designed to operate, as well as coins minted by countries other than those for which the preferred embodiment is designed to operate and slugs or other devices designed to cheat the machine. The term "bogus coin" is used to define any coin which is not a valid coin.

Figure 1:
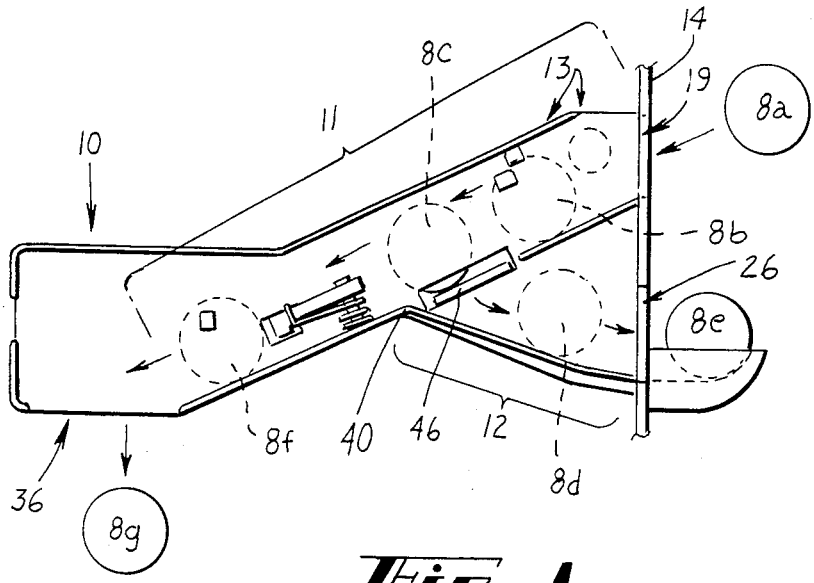
FIG. 1 schematically illustrates the paths of travel of a coin through the preferred embodiment of the present invention.

Looking first at FIG. 1, the preferred embodiment of the coin validator apparatus 10 of the present invention provides two separate alternative pathways along which a coin 8 may travel. A first or long pathway or ramp 11 extends from a coin receiving slot or opening 19 at a downward linear incline to a coin discharge opening 36. A second or short pathway or ramp 12 extends in a direction generally opposite the long pathway 11 from a predetermined point 40 along the long pathway intermediate the ends thereof and at a downward incline to a coin return outlet 26. Electronic coin sensing devices 13 comprising a content-measuring coil shown in phantom and light detecting devices are positioned along the long pathway 11 prior to the predetermined point 40.

A pivotable guide member or flipper 46 directs valid coins along the long pathway 11 and diverts invalid or bogus coins along the short pathway 12 to be returned. A coin 8*a* is introduced into the coin accepting opening, and sensed by the electronic sensing devices 13. If the coin is detected as bogus, the flipper 46 will pivot (out of the plane of the drawing) to allow the coin 8*d* to fall downwardly onto the short pathway 12, and out of the coin return outlet as a returned coin 8*e*.

A valid coin 8*c*, on the other hand, will cause the flipper 46 to remain in position and guide the coin 8*c* down the long pathway. The coin 8*f* travels down the long pathway and exits the coin discharge opening 36 as a valid coin 8*g*.

Figure 3:
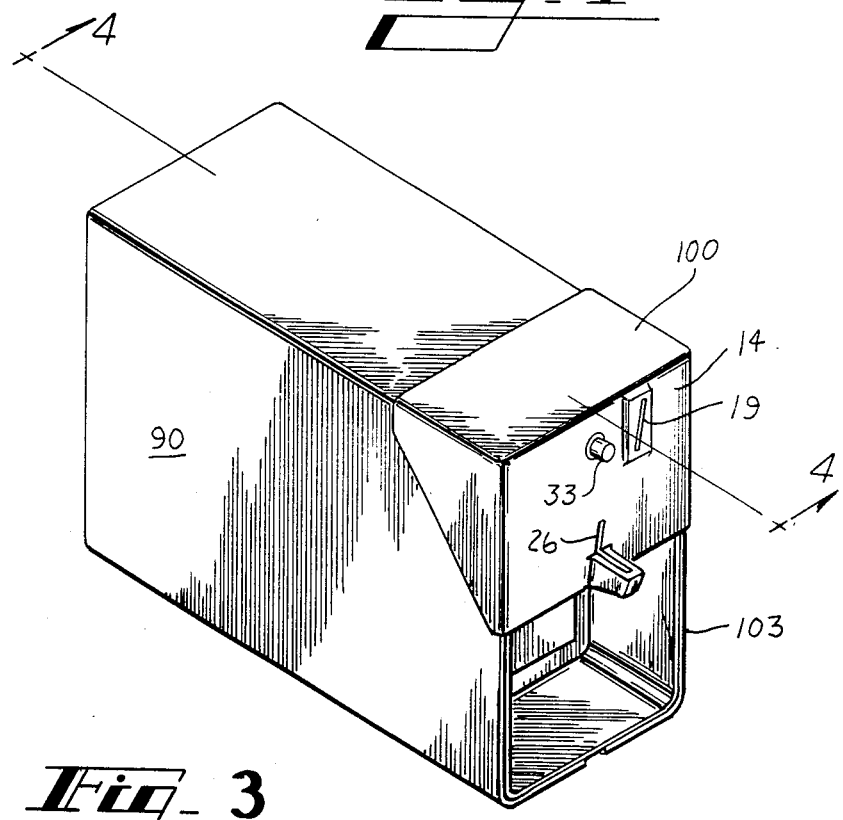
FIG. 3 is a perspective view of illustrating the adaptation of the preferred embodiment of FIG. 2 to a conventional coin meter case.
Figure 2:
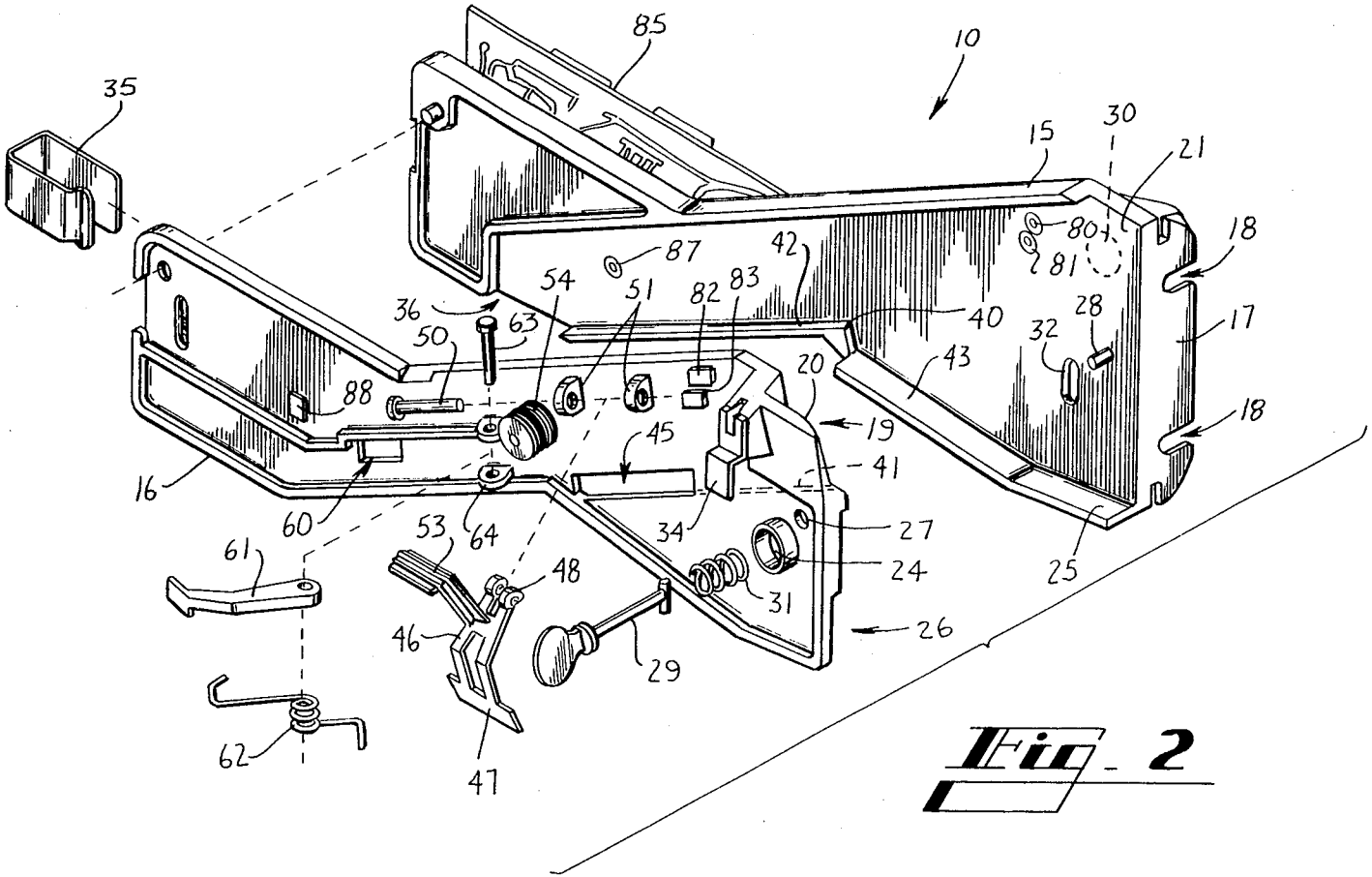
FIG. 2 is an exploded view of a preferred embodiment of a coin validation apparatus constructed according to the present invention.
Figure 4:
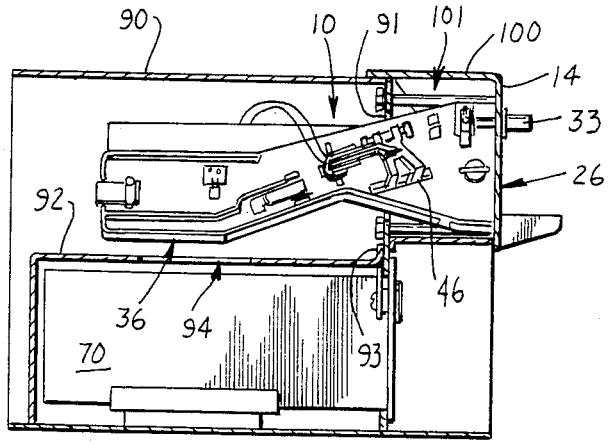
FIG. 4 is a cross-sectional view taken along the line 4—4 of FIG. 3.

Turning now to FIG. 2, an exploded view p of the preferred embodiment is shown. The coin validator or validation apparatus 10 comprises a right side half 15 and a left side half 16. The left and right side halves 15, 16 define spaced apart walls for confining a generally vertical rolling coin between the walls. Attached to the right side half 15 is a front mounting plate 17 having a plurality of slots 18 for receiving bolts or screws for attaching the validator 10 to a housing mounting plate 14 (FIGS. 1, 3, and 4).

Figure 7A:
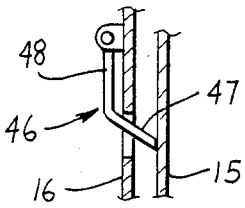
FIG. 7, consisting of FIGS. 7A and 7B, is a partial sectional view taken along the line 7—7 of FIG. 5 showing the pivotable coin guide in the first and second positions, respectively.

At the top of the preferred embodiment 10 is a coin accepting opening 19 (see FIGS. 10, 11) which includes a left side guide wall 20 and a right side guide wall 21. As will be familiar to those skilled in the art, the coin accepting opening 19 is parallel to a slot (not shown) in the housing mounting plate 14 which accepts the coins. If the coins are introduced at a high velocity, they will strike a tapered ridge 23 (FIGS. 7, 8) and be forced to fall sideways against the wall 21 of the right side half.

Figure 5:
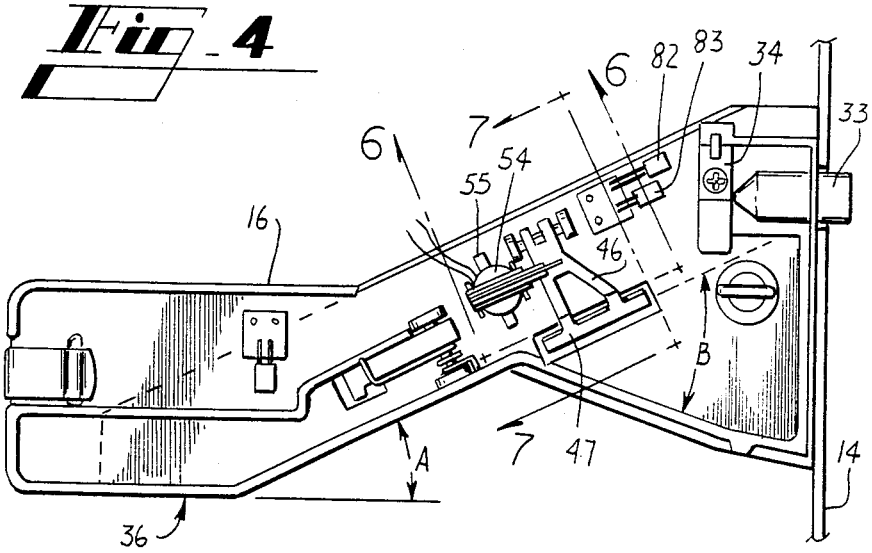
FIG. 5 is a side elevational view of the exterior of the left side half of the preferred embodiment of FIG. 2.

Near the bottom of the validator is a lip 25 forming a portion of the short pathway 12 at coin return outlet 26. As will be apparent from the explanation below, a coin which is detected as bogus will exit this path when the preferred embodiment is in use. A boss 27 formed in the left side half 16 is journaled around a rod 28 in the right side half 15 to orient the left and right side halves properly. A quarter-turn key 29 is received through a slotted opening 24 in the left side half and thence to a slotted opening 32 in the right side half 15. A spring 31 fitted about key 29 urges sidewalls 15 and 16 together. A spring clip 35 further holds the side halves 15, 16 together. A spring clip 35 further holds the side halves 15, 16 together. A conventional scavenger apparatus 33 (FIG. 5) is provided for engaging with a flange 34 mounted to the left side half 16 in a conventional manner for forcing sidewalls 15 and 16 apart in order to unjam a coin which might become jammed in the interior of the validator.

Still referring to FIG. 2, it should now be appreciated that the left and right side halves 15, 16 define a generally Y-shaped coin chute having a first long coin ramp or path 11 beginning at the coin accepting opening 19 and downwardly sloping along a line toward a second coin-discharge end or opening 36. The coin-discharge opening 36 in the preferred embodiment is positioned over a coin box (FIG. 4)—the ultimate destination of a valid coin—for discharging an accepted coin into the coin box. The long coin path 11 is more particularly defined by an upper guide lip 41 formed on the interior of the left side half 16, and a lower guide lip 42 formed on the interior wall of the right side half 15. The long coin path 11 in the preferred embodiment has a slope of about 25 degrees (angle A in FIG. 5) with respect to the horizontal.

The generally Y-shaped coin chute further comprises a second short coin ramp or path 12 which intersects the long coin path intermediate the ends thereof at a predetermined point 40 and defines a second downwardly sloping coin ramp partially defined by the lip 25 for receiving a rejected coin from the long coin path and for returning the rejected coin to the coin return opening or outlet 26 which is generally positioned beneath the coin accepting opening 19. This coin return outlet comprises the final destination of bogus coins. The short coin path further comprises a lip extension 43 formed in the right side half 15 beginning immediately beneath the predetermined point 40 and extending in a downwardly direction to adjoin with the lip 25 defining a portion of the coin return outlet 26. The short coin path 12 in the preferred embodiment angularly intersects the long coin path at an angle of about 40 degrees (angle B in FIG. 5) to provide adequate slope to return a rejected coin.

An elongate slot 45 is provided in the left side half 16 generally aligned with the upper guide lip 41 but terminating short of the predetermined point 40. Thus, the upper guide lip 41 terminates adjacent to the slot 45 such that there is a vertical opening along the long coin path disposed immediately above the lip extension 43 and sized such that a coin will drop from the upper guide lip 41 downwardly onto the lip extension 43 and thence to the coin return outlet in the absence of some constraining factor.

Provided for the purpose of continuing a valid coin along the long coin path is a pivotable guide member or flipper 46, of which the elongate lower end 47 is received in the slot 45. The upper end 48 of the guide member 46 receives a hinge pin 50 which is inserted through support extensions 51 and allows the guide member 46 to pivot into and away from the slot 45. The lower end 47 is angularly inclined with respect to the upper end 48, as more particularly illustrated in FIGS. 7A and 7B, so that when the guide member 46 is maintained in the space between the left and right sidewalls 15, 16, the lower end 47 forms an extension of the upper guide lip 41 which guides a coin past the predetermined point and onto the lower guide lip 42. If allowed to pivot to a second position shown at 46' (FIGS. 6B, 7B) by virtue of the weight of a coin 8, the coin 8 will be released to fall from the upper guide lip 41 downwardly onto the lip extension 43.

Figure 6A:
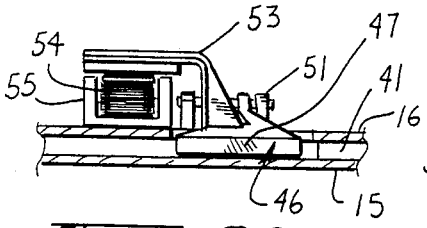
FIG. 6, consisting of FIGS. 6A and 6B, is a partial sectional view taken along the line 6—6 of FIG. 5 showing the pivotable coin guide in the first and second positions, respectively.
Figure 6B:
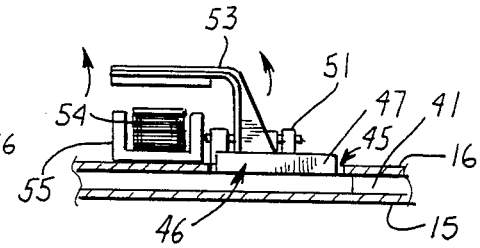
Figure 7B:
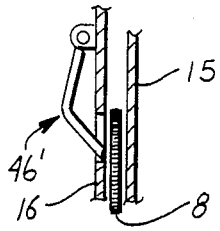
Figure 9:
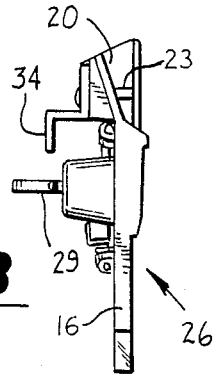
FIG. 9 is a front elevational view of the left side half of the preferred embodiment of FIG. 2.
Figure 8:
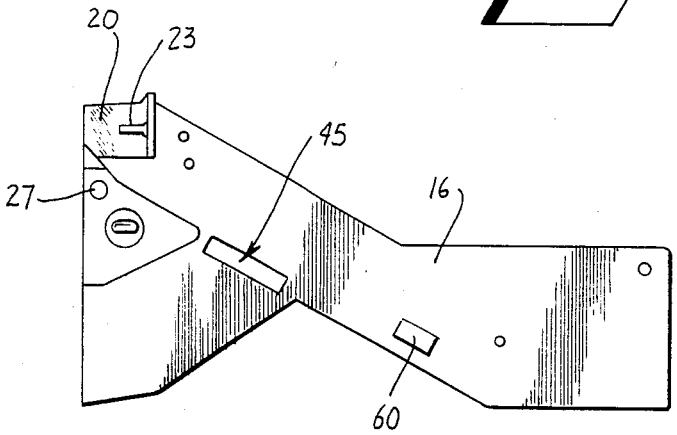
FIG. 8 is an interior side elevational view of the left side half of the preferred embodiment of FIG. 2.

The pivotable guide member 46 is biased into the slot 45 so as to guide valid coins from the upper guide lip to the lower guide lip when a valid coin is detected. In order to provide this function, there is affixed to the guide member 46 a ferromagnetic metallic arm 53 which extends outwardly away from the left side half 16 and dog-legs to extend generally parallel to the left side to an electromagnetic coil 54, as more clearly illustrated in FIGS. 6A, 6B. The electromagnetic coil 54 is mounted on a generally E-shaped member 55 made of magnetic material such as iron or the like, with the center portion or leg of the "E" exending through the center of the coil 54. The E-shaped member is mounted to the left side half 16, and when the electromagnetic coil 54 is energized, the field produced thereby is transmitted through the legs of the "E" to attract the metallic arm 53 and to thereby hold the guide member 46 in a first position substantially aligned with the slot 45 so that the lower end 47 bridges the gap between the upper guide lip 41 and the lower guide lip 42 to allow a coin to continue travelling along the long coin path. In the absence of an electromagnetic field, the weight of the coin will urge and displace the guide member 46 to a second position away from the long coin path as shown in FIGS. 6B and 7B, allowing the coin to fall onto the short coin path and to the coin return outlet 26.

Advantageously, the combination of the electronic coin sensing and the diversion of a bogus coin to the return coin path in the absence of an valid coin indication from the circuit ensures that such bogus coins will be rejected and returned before the rolling coin has achieved sufficient rolling inertia to bypass the guide member 46 and be counted as valid, as for example when coins are introduced with high velocity in an attempt to cheat the machine.

Also provided in the left side half 16 is a slot 60 positioned down the long coin path 11 generally in the section of the coin path containing the lower guide lip 42, for receiving a conventional coin stripper member 61 for stripping tape, string, and the like from a valid coin which has successfully bridged the gap between the upper and lower guide lips. The stripper member 61 is biased into the slot 60 by a spring 62 to engage the stripper member behind a coin after it passes beyond the stripper member toward the coin box. A hinge pin 63 is received in support extensions 64 to mount the stripper member 61 for pivotable movement.

After a coin has successfully passed beyond the stripper member 61, it will then exit the coin discharge opening 36 which is positioned at the lowermost end of the lower guide lip 42 at the end of the long coin path. The coin can then drop into a coin box 70 such as shown in FIG. 4.

In order to detect the presence of a valid coin travelling along the upper guide lip 41 of the long coin path, there is provided a coil 30 for detecting the metal content of the coin. This coil 30 corresponds to the coil 30 described in the co-pending application Ser. No. 525,997, filed 8-24-83 now U.S. Pat. No. 4,509,633, which is hereby incorporated herein by reference and made a part hereof. As shown in FIG. 2, the coil 30 is mounted to the right side half 15 such that it may detect the metal content of a coin immediately after introduction of the coin into the coin accepting opening 19.

Also disposed along the long coin path and subsequent to the coil 30 are a pair of openings 80, 81 in the right side half 15 in which are placed a pair of optical sensors (not shown). A pair of light emitting devices 82, 83 are mounted to the left side half 16 to emit light through the space between the left and right side halves and into the detectors mounted in the openings 80, 81. These light emitting and detecting devices comprise a coin diameter sensing apparatus such as described in the referenced incorporated patent application.

Accordingly, it will be understood that the combination of the coil 30, and light emitting and detecting devices, comprise electronic coin sensing means positioned along the first coin path prior to the point at which the short coin path begins, for sensing the presence of a valid coin travelling along the upper guide lip 41. It will also be understood that the apparatus disclosed in the incorporated patent application comprises electronic coin metal content measuring means for providing a content valid output signal in response to detection of a coin having a metal content within one of a plurality of predetermined ranges of content values, diameter measuring means for providing a valid diameter output signal in response to detection of a coin diameter being within one of a plurality of predetermined ranges of diameter values, and circuit means responsive to the valid diameter output signal and the content output valid signal for providing a "valid coin" signal. Those skilled in the art will now understand that the apparatus described in the incorporated co-pending application is responsive to provide a signal in the presence of a valid coin, which signal can then be employed to create an electromagnetic field in the electromagnetic coil 54, thereby maintaining the guide member 46 in the slot 45 so as to complete the predetermined long coin pathway from the coin receiving opening to the coin discharge opening.

It will be further understood that the electromagnetic coil 54, metallic arm 53 and pivotable guide member 46 comprise coin directing or guiding means positioned along the long coin path at or proximate to the predetermined point of beginning of the second or short coin path and responsive to a signal from the coin sensing means for guiding the valid coin past the predetermined point toward the coin box, but for releasing a rejected coin to fall to the lower coin-rejecting short coin path. Advantageously, the disclosed apparatus responds more quickly than solenoid-type coin diverting or guiding devices because there is no mechanical inertia which must be overcome before the device can perform its coin diverting function.

The terminals of the light emitting devices and light detectors, the coil 30, and the electromagnetic coil 54 are connected by wires (not shown) to a circuit board 85 which is mounted to the right side half 15.

Also provided is apparatus for detecting the passage of a coin beyond the coin stripper member 61 and for providing a signal indicative of the passage of a coin into the coin box. An opening 87 is provided in the right side half 15 for mounting a light detector positioned along the long coin path and above the lower guide lip 42 near the coin discharge opening 36. A light emitting device 88 is mounted to the left side half 16 to emit light that can be detected by the light detector in the opening 87, such that a coin passing in front of the opening 87 will interrupt the light, and provide a signal to the circuitry on the circuit board 85 which can signify that a coin has entered the coin box.

Figure 10:
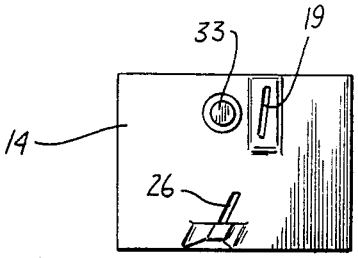
FIG. 10 is a front view of the coin meter case of FIG. 3 illustrating the angles of inclination of the coin receiving opening and the coin return opening of the preferred embodiment.
Figure 11A:
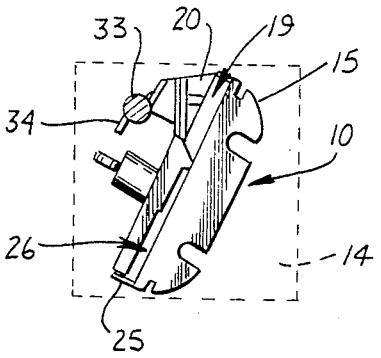
FIG. 11, consisting of FIGS. 11A and 11B, are front views of the preferred embodiment of FIG. 2, with FIG. 11B illustrating separation of the right side half and left side half to release a jammed coin.
Figure 11B:
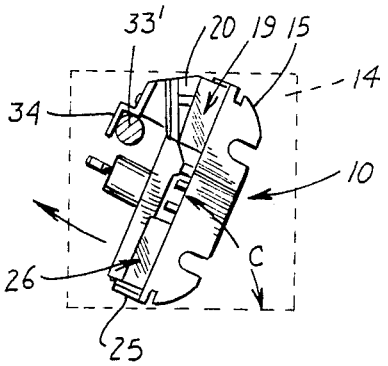

As illustrated in FIGS. 10 and 11, the preferred embodiment of the validator 10 is mounted at a predetermined angular inclination with respect to the vertical such that one side of a rolling coin travelling along the coin path will contact with the lowermost one of the walls, which in the preferred embodiment is the interior wall 21 of the right side half 15. In the preferred embodiment, the angular inclination of the validator is about 65 degrees with respect to horizontal (angle C in FIG. 11B).

Since the coil 30 employed to detect the metal content of the coins works most reliably when the coins are maintained a constant predetermined distance above the coil, the combination of the guide walls 20, 21 and ridge 23 at the coin accepting opening 19 guide the coin into the coin accepting opening such that the coin will lie against and rollingly contact the lowermost wall 21 as it enters the coin pathway. Accordingly, the return outlet 26 is positioned below and to the left of the coin accepting opening 19 as illustrated in FIG. 10. Thereby, the coin is maintained a predetermined distance above the coil 30, which predetermined distance comprises the thickness of the lowermost wall 21.

As shown in FIGS. 11A and 11B, in order to unjam a coin which might inadvertently become stuck between the side halves 15, 16, depressing the scavenger button 33 to the position shown at 33' where it engages with the flange 34 separates the walls 15 and 16 to free the coin.

As discussed above, one the principal advantages of the present invention is that it allows the detection and acceptance or rejection of a coin in a limited vertical and horizontal space. Referring now to FIGS. 3 and 4, a conventional coin meter case 90 which has been retrofit with the preferred embodiment of the present invention is illustrated. As best seen in FIG. 4, the validator 10 is mounted to a housing mounting plate 14 which is in turn mountable to the coin meter case 90. A typical coin meter case intended originally to house a conventional coin-slide type validation apparatus often comprises a vertical front wall 91 for mounting and supporting the coin validator. The coin meter case typically further includes an interior horizontal floor 92 disposed beneath the coin validator 10 which includes a coin box opening 94 for allowing valid coins from the coin validator to enter the coin box 70 position beneath the floor 92. The front wall 91 includes a lower vertical wall portion 93 which extends to a predetermined height (typically about ¾ inch) above the floor 92 to define an opening 95 (FIG. 12A) for receiving that portion of the coin validator 10 which is positioned over the coin box 70.

The preferred embodiment of the housing mounting plate 14 for use in connection with the preferred coin validator 10 includes horizontal upper portion 100 (FIG. 3) which extends about two inches between the housing mounting plate 14 and the vertical front wall 91 to enclose a space 101 wherein the coin validator accomplishes the detection and acceptance or rejection of the coins prior to the passage of the coins past the vertical front wall 91. Advantageously, therefore, the coin validator 10 is received in the opening 95 (FIGS. 12A, 12B) without requiring any modifications to the coin meter case, yet can still detect and accept or reject coins within the limited vertical and horizontal space 101 between the housing mounting plate 14 and the vertical front wall 91 of the coin meter case 90. The valid coins will continue travelling down the long pathway and enter the space beyond the front wall 91 to discharge the coins into the coin box 70, while rejected coins will be released by the pivotable guide member 46 prior to the coins' entry beyond the front wall. The angular inclination of the second or short coin path allows the coins to roll along the short coin path and out coin return outlet 26.

Figure 12A:
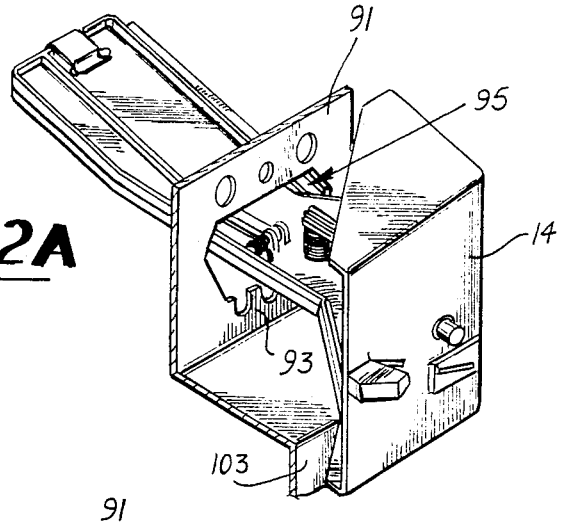
FIG. 12, consisting of FIGS. 12A and 12B, illustrate the insertion of the preferred embodiment of the present invention into the front wall opening of a conventional coin meter case such as illustrated in FIG. 3.
Figure 12B:
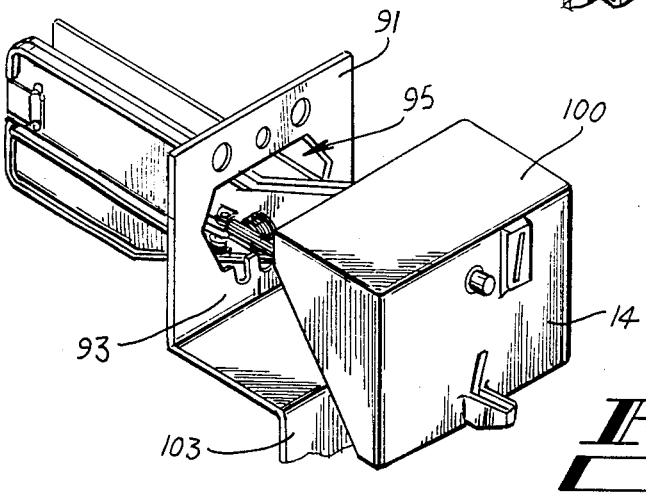

As shown in FIGS. 12A and 12B, in order to insert the coin validator 10 through the opening 95, because of the width of the validator toward the end containing the coin discharge opening 36 may be greater than the height of the opening 94, first the validator assembly comprising the validator apparatus 10 and the housing mounting plate 14 are inserted through the opening 95 by inserting the widest part of the validator through the width of the opening 95. When the narrowest portion of the validator 10 (the portion near the predetermined point 40 of beginning of the short return coin path, only about 1⅛ inch in the preferred embodiment) has entered beyond the front wall 91, the assembly is rotated 90 degrees to that shown in FIG. 12B. The assembly is then moved inwardly of the coin meter case such that the upper portion 100 covers the space 101 while the housing mounting plate 14 is flush with the front portions 103 of the coin meter case 90.

From the foregoing description, it will be appreciated by those skilled in the art that the present invention accomplishes the objectives set forth above. It will further be appreciated that, in view of the disclosure herein, other embodiments of the present invention will suggest themselves to those skilled in the art, and thus the scope of the present invention is to be limited only by the claims below.

I claim:

1. Coin validation apparatus, comprising:

coin introducing means for receiving a coin in a generally vertical orientation and for guiding the coin to roll into the apparatus;

a first downwardly inclined coin path for guiding a rolling coin along a predetermined first pathway toward a coin box;

a second downwardly inclined coin path beginning at a predetermined point along said first coin pathway and positioned below said first coin pathway for directing a rejected coin from said first coin path along a predetermined second pathway toward a coin return outlet;

electronic coin sensing means positioned along said first pathway prior to said second pathway for sensing the presence of a valid coin traveling along said first pathway and for providing a valid coin signal;

a pivotable guide member capable of assuming a first position substantially aligned with said first coin path for guiding a valid coin toward said coin box and an alternate second position away from said first coin path in response to the weight of a coin for releasing a rejected coin from said first pathway to said second pathway; and means for holding said guide member in said first position in response to said valid coin signal, whereby an invalid coin detected by said coin sensing means will fall downwardly from said first coin path onto said second coin path and thence into said coin return outlet, while a valid coin will continue along said first coin path toward and thence into said coin box.

2. The apparatus of claim 1, wherein said first coin path includes a left wall and a spaced apart right wall for confining a rolling coin between said walls, and wherein said electronic coin sensing means are affixed to one of said walls.

3. The apparatus of claim 2, further comprising means for mounting said first coin path at a predetermined angular inclination with respect to vertical such that one side of a rolling coin travelling along said first coin path will contact with the lowermost one of said walls, whereby the coin will travel past said electronic coin sensing means spaced a predetermined distance apart from said electronic coin sensing means.

4. The apparatus of claim 3, wherein said electronic coin sensing means comprises electronic coin metal content sensing means, and wherein said predetermined distance comprises the thickness of said lowermost one of said walls.

5. The apparatus of claim 3, further comprising ridge means affixed to one of said walls proximate to said coin introducing means for guiding a generally vertically-received coin into said coin introducing means and against said lowermost one of said walls such that the side of the coin contacts with said lowermost one of said walls as the coin enters the apparatus.

6. The apparatus of claim 2, further comprising coin release means operatively positioned to separate said left wall and said right wall for enlarging the space between said walls to release a jammed or stuck coin.

7. The apparatus of claim 1, wherein said electronic coin sensing means comprises:

electronic coin metal content measuring means for providing a content valid output signal in response to detection of a coin having a metal content within one of a plurality of predetermined ranges of content values; diameter measuring means for providing a valid diameter output signal in response to detection of a coin diameter being within one of a plurality of predetermined ranges of diameter values; and circuit means responsive to said valid diameter output signal and said content output valid signal for providing said valid coin signal.

8. The apparatus of claim 1, wherein said guide member holding means comprises:

electromagnetic coil means for generating an electromagnetic field in response to said valid coin signal; and electromagnetically responsive means affixed to said guide member and operatively coupled to said electromagnetic coil means for maintaining said guide member in said first position in the presence of an electromagnetic field but allowing said guide member to move to said second position in the absence of an electromagnetic field to allow a rejected coin to fall onto said second pathway.

9. The apparatus of claim 1, wherein said guide member includes an elongate guide surface having an angular inclination with respect to the plane of travel of the coin along said first pathway for urging said guide member from said first position to said second position under the influence of the weight of a coin when said holding means does not hold said guide member in said first position.

10. The apparatus of claim 1, further comprising coin stripping means positioned along said first coin path past said predetermined point along said first pathway for stripping tape, string, and the like from a valid coin.

11. The apparatus of claim 10, wherein said coin stripping means comprises a stripper member bearing downwardly into the plane of said first pathway prior to said coin box, and spring means for biasing said stripper member into said first pathway to engage behind a coin after it passes beyond said stripper member toward said coin box.

12. The appparatus of claim 1, further comprising coin detection means positioned along said first pathway past said predetermined point toward said coin box for detecting the passage of a coin into the coin box and for providing a coin detected signal.

13. The apparatus of claim 12, wherein said coin detection means comprises light emitting means positioned on one side of said first pathway and light detecting means positioned on the other side of said first pathway for detecting the interruption of light emitted by said light emitting means as a coin travels past said light detecting means.

14. In or for a coin meter case for housing a coin validation apparatus and a coin box for receiving valid coins, said coin meter case comprising a vertical front wall for mounting and supporting said coin validation apparatus, an interior horizontal floor disposed beneath said coin validation apparatus and including a coin box opening for allowing valid coins from said coin validation apparatus to enter a coin box positioned beneath said floor, and said front wall including a vertical wall portion extending to a predetermined height above said floor to define an opening in said front wall for receiving a portion of said coin validation apparatus positioned over said coin box opening, an improved coin validation apparatus for sensing and accepting or rejecting a coin prior to the travel of the coin beyond said front wall, comprising:

a vertical mounting plate including an upper coin receiving opening and a lower coin return opening and attachable to said coin meter case adjacent to said front wall to define a space between said mounting plate and said front wall;

means mounted to said mounting plate for receiving a coin in a generally vertical orientation and for guiding the coin to roll into the apparatus;

means defining a first downwardly inclined coin path positioned subsequent said coin receiving means for guiding a rolling coin downwardly along a predetermined first pathway toward said first wall opening and thence into said coin meter case toward said coin box opening;

means defining a second downwardly inclined coin path beginning at a predetermined point proximate to the uppermost extent of said vertical wall portion and positioned below said first pathway for directing a rejected coin from said first coin path along a predetermined second pathway extending generally from the uppermost extent of said vertical wall portion to said lower coin return opening;

electronic coin sensing means positioned along said first pathway prior to said predetermined point of beginning of said second pathway for sensing the presence of a valid coin traveling along said first pathway and for providing a valid coin signal;

a pivotable guide member capable of assuming a first position substantially aligned with said first coin path for guiding a valid coin toward said coin box and an alternate second position away from said first coin path in response to the weight of a coin for releasing a rejected coin from said first pathway to said second pathway; and means for holding said guide member in said first position in response to said valid coin signal, whereby an invalid coin detected by said coin sensing means will fall downwardly from said first coin path onto said second coin path and thence into said coin return opening, while a valid coin will continue rolling along said first coin path toward and thence into said coin box.

15. The improvement of claim 14, wherein said first coin path extends generally in a line from said coin receiving means through said front wall opening and terminates at a point lower than said coin receiving means positioned above said coin box opening.

16. The improvement of claim 14, wherein said second coin path extends generally in a line from said predetermined point through said space between said mounting plate and said front wall and terminates at said coin return opening.

17. A coin validation apparatus for providing detection and acceptance or rejection of a coin in a limited vertical space, comprising:

means defining a generally Y-shaped coin chute having a first long coin path and a second short coin path intersecting said long coin path intermediate the ends thereof at a predetermined point;

means for mounting said Y-shaped coin chute such that said long coin path defines a first downwardly sloping coin ramp having a first coin-receiving end for receiving a coin in a generally vertical orientation and a second coin-discharging end positioned over a coin box for discharging an accepted coin into the coin box, with said short coin path defining a second downwardly sloping coin ramp for receiving a rejected coin from said long coin path and returning the rejected coin to a coin return opening positioned generally beneath said coin-receiving end of said first coin ramp, said long coin path being supported by said mounting means at a predetermined angular inclination with respect to vertical such that the side of a rolling coin travelling along said long coin path will contact with a wall of said long coin path;

an electronic coin sensing means mounted to said wall of said long coin path between said coin-receiving end and said predetermined point for sensing the presence of a valid coin travelling along said long coin path and for providing a valid coin signal when a valid coin is detected;

a a pivotable guide member positioned along said long coin path and capable of assuming a first position substantiallly aligned with said long coin path for guiding a valid coin past said predetermined point along said long coin path toward said coin box and an alternate second position away from said long coin path in response to the weight of a coin for releasing a rejected coin to fall downwardly from said long coin path to said short coin path and thence to said coin return opening in the absence of said valid coin signal; and means for holding said guide member in said first position in response to said valid coin signal.

18. Coin validation apparatus, comprising:

coin introducing means for receiving a deposited coin;

a first linear pathway connected to said coin introducing means and extending in a linear first direction from said coin introducing means toward a first destination;

a second pathway for receiving a diverted coin from said first pathway and for guiding the coin in a second direction extending at a predetermined angle with respect to said first pathway toward a second destination;

a linear continuation pathway extending in a direction substantially collinear with said first direction for receiving a coin from said first pathway and for guiding the coin toward said first destination;

electronic coin sensing means for sensing the presence of a coin traveling along said first pathway and for providing a coin present signal;

a pivotable guide member capable of assuming a first position substantially aligned with said first direction for guiding a valid coin toward said continuation pathway and an alternate second position away from said first pathway in response to the weight of a coin for releasing a rejected coin from said first pathway to said second pathway; and means for holding said guide member in said first position in response to said coin present signal and for releasing said guide member in the absence of said coin present signal.

19. The apparatus of claim 18, wherein said predetermined angle is less than ninety degrees.

20. The apparatus of claim 19, wherein said predetemined angle is about forty degrees.

21. The apparatus of claim 18, wherein said first destination comprises a coin box, and wherein said second destination comprises a coin return outlet.

22. In or for a coin responsive apparatus, said apparatus comprising a first coin pathway for guiding a coin to a first destination, a second coin pathway for guiding a coin to a second destination, and coin sensing means for sensing a coin and responsive to provide a coin signal, an improved coin directing device for directing coins along said first coin pathway or alternatively along said second coin pathway, comprising:

a movable arm capable of assuming a first position substantially aligned with said first coin pathway and defining a portion of said first coin pathway for guiding a coin along said first pathway, and an alternate second position away from said first coin pathway in response to the weight of a coin for guiding the coin along said second coin pathway;

ferromagnetic means mounted to said movable arm and responsive to the presence of an electromagnetic field for maintaining said movable arm in said first position; and electromagnetic coil means electromagnetically coupled to said ferromagnetic means for providing said electromagnetic field in response to said coin signal.

23. In a coin responsive apparatus, said apparatus comprising a first coin pathway for guiding a coin to a first destination for accepted coins, a second coin pathway, intersecting said first coin pathway, for guiding a coin to a second destination for rejected coins, and coin sensing means for sensing a coin and responsive to provide a coin signal, an improved coin directing device for directing coins along said first coin pathway or alternatively along said second coin pathway, comprising:

a movable arm pivotally mounted adjacent to said first coin pathway for assuming a quiescent first position at which a first end portion of said arm defines a portion of said first coin pathway for guiding a coin along said first pathway, and for alternatively assuming a second position at which said first end portion is removed from said first coin pathway in response to a coin of a predetermined weight engaging said first end portion, allowing said coin to fall to said second coin pathway;

electronic retaining means mounted to a second end portion of said movable arm for maintaining said movable arm in said first position during the concurrent presence of an electromagnetic field condition at said second end portion and said coin of predetermined weight at said first end portion; and electromagnetic field means electromagnetically coupled to said electronic retaining means for providing said electromagnetic field condition in response to said coin signal.

* * * * *